US012409372B2

(12) United States Patent
Lee et al.

(10) Patent No.: US 12,409,372 B2
(45) Date of Patent: Sep. 9, 2025

(54) VIRTUAL GOLF SIMULATION DEVICE AND VIRTUAL GOLF SIMULATION METHOD

(71) Applicant: GOLFZON CO., LTD., Seoul (KR)

(72) Inventors: Kyung-yong Lee, Seoul (KR); Bong-ho Song, Seoul (KR); Jin-hyung Choi, Seoul (KR)

(73) Assignee: GOLFZON Co., Ltd., Seoul (KR)

( * ) Notice: Subject to any disclaimer, the term of this patent is extended or adjusted under 35 U.S.C. 154(b) by 311 days.

(21) Appl. No.: 18/178,608

(22) Filed: Mar. 6, 2023

(65) Prior Publication Data

US 2023/0201688 A1 Jun. 29, 2023

Related U.S. Application Data

(63) Continuation of application No. PCT/KR2021/010864, filed on Aug. 17, 2021.

(30) Foreign Application Priority Data

Sep. 29, 2020 (KR) ..... 10-2020-0127079

(51) Int. Cl.
*A63B 69/36* (2006.01)
*A63B 24/00* (2006.01)
*A63B 71/06* (2006.01)

(52) U.S. Cl.
CPC ..... *A63B 69/3623* (2013.01); *A63B 24/0021* (2013.01); *A63B 69/3658* (2013.01);
(Continued)

(58) Field of Classification Search
CPC ..... A63B 69/3623; A63B 24/0021; A63B 69/3658; A63B 71/0622; A63B 2024/0034; A63B 2071/0636
See application file for complete search history.

(56) References Cited

U.S. PATENT DOCUMENTS

2010/0081520 A1* 4/2010 Peterson ..... A63B 69/3658 473/409
2012/0016599 A1* 1/2012 Ishii ..... A63B 71/02 702/33

(Continued)

FOREIGN PATENT DOCUMENTS

JP 2013-516211 A 5/2013
KR 10-2009-0070857 A 7/2009

(Continued)

OTHER PUBLICATIONS

FSX2020, Playing Pebble Beach Golf Course on FSX 2020 (Foresight Sports GCQuad), https://www.youtube.com/watch?v=PADx0JT3r50. Jul. 15, 2020 (Year: 2020).*

(Continued)

*Primary Examiner* — Reginald A Renwick
(74) *Attorney, Agent, or Firm* — Sughrue Mion, PLLC

(57) ABSTRACT

There are proposed a virtual golf simulation device and a virtual golf simulation method. According to an embodiment, there is proposed a virtual golf simulation device, including: a memory configured to store a hardness value indicative of the degree of hardness of a terrain in a virtual golf course; and an image processor configured to simulate the movement trajectory of a ball on the virtual golf course based on shot data on a user's golf shot and the hardness value.

15 Claims, 12 Drawing Sheets

(52) U.S. Cl.
CPC .. *A63B 71/0622* (2013.01); *A63B 2024/0034* (2013.01); *A63B 2071/0636* (2013.01)

(56) References Cited

U.S. PATENT DOCUMENTS

| | | | | |
|---|---|---|---|---|
| 2013/0158966 | A1 | 6/2013 | Baek et al. | |
| 2013/0281223 | A1 | 10/2013 | Lee et al. | |
| 2015/0367222 | A1* | 12/2015 | Ripp | G06N 5/04 473/409 |
| 2020/0164258 | A1 | 5/2020 | Tuxen | |

FOREIGN PATENT DOCUMENTS

| | | | |
|---|---|---|---|
| KR | 10-2011-0042640 | A | 4/2011 |
| KR | 10-1031432 | B1 | 4/2011 |
| KR | 10-1217215 | B1 | 12/2012 |
| KR | 10-2013-0068613 | A | 6/2013 |
| KR | 10-2015-0022412 | A | 3/2015 |
| KR | 10-1525413 | B1 | 6/2015 |
| KR | 10-1578343 | B1 | 12/2015 |
| KR | 10-2019-0106259 | A | 9/2019 |
| KR | 10-2020-0046774 | A | 5/2020 |
| WO | 2012/002751 | A2 | 1/2012 |
| WO | 2020/109974 | A1 | 6/2020 |

OTHER PUBLICATIONS

International Search Report dated Dec. 24, 2021, issued in International Application No. PCT/KR2021/010864.

* cited by examiner

VIRTUAL GOLF SIMULATION DEVICE AND VIRTUAL GOLF SIMULATION METHOD

TECHNICAL FIELD

The embodiments disclosed herein relate to a virtual golf simulation device and a virtual golf simulation method, and more particularly to an apparatus and method that perform virtual golf simulation based on a hardness value indicative of the degree of hardness of a terrain in a virtual golf course.

BACKGROUND ART

Recently, the popularity of screen golf ranges has been increasing. As screen golf ranges, which are cheaper to use than actual golf courses and can be enjoyed without restrictions on time, location, and the like, have been opened within users' living areas, anyone can easily enjoy golf simulation games.

With the emergence of various screen golf service providers, the expectations of users who play screen golf games are rising. Users desire to enjoy rounds of golf in a more realistic environment.

Meanwhile, there are various factors that affect the outcome of a golf game when golf is played on an actual golf course. For example, although a player's golf shot ability also has an effect, the environment in which the player plays a game, such as weather or terrain, also has a significant effect.

However, currently proposed screen golf systems have limitations in providing virtual golf simulation while incorporating the states of a terrain thereinto. As a result, it is difficult for the currently proposed screen golf systems to provide a realistic golf game to users.

In connection with this, Korean Patent No. 10-2009-0070857, which is prior art literature, describes a screen golf system, but does not propose a technology for providing a realistic golf game by taking into consideration an environment as described above.

Therefore, there is a demand for a technology for overcoming the above-described problems.

Meanwhile, the above-described background technology corresponds to technical information that has been possessed by the present inventor in order to contrive the present invention or that has been acquired in the process of contriving the present invention, and can not necessarily be regarded as well-known technology that had been known to the public prior to the filing of the present invention.

DISCLOSURE

Technical Problem

An object of the embodiments disclosed herein is to propose a virtual golf simulation device and a virtual golf simulation method.

Another object of the embodiments disclosed herein is to propose a virtual golf simulation device and a virtual golf simulation method that simulate the movement trajectory of a ball according to a hardness value indicative of the degree of hardness of a terrain in a virtual golf course.

Another object of the embodiments disclosed herein is to propose a virtual golf simulation device and a virtual golf simulation method that may more realistically implement bounce and rolling.

Technical Solution

As a technical solution for overcoming the above-described technical problems, the embodiments disclosed herein are directed to an apparatus and method that perform virtual golf simulation based on a hardness value indicative of the degree of hardness of a terrain in a virtual golf course.

Advantageous Effects

According to one of the above-described solutions, there may be proposed the virtual golf simulation device and the virtual golf simulation method.

According to one of the above-described solutions, there may be proposed the virtual golf simulation device and the virtual golf simulation method that simulate the movement trajectory of a ball according to a hardness value indicative of the degree of hardness of a terrain in a virtual golf course.

According to one of the above-described solutions, there may be proposed the virtual golf simulation device and the virtual golf simulation method that may more realistically implement bounce and rolling. Accordingly, a user's sense of immersion in a golf game may be maximized by realizing a driving distance as in an actual golf course.

The effects that can be obtained by the embodiments disclosed herein are not limited to the above-described effects, and other effects that have not been described above will be clearly understood by those having ordinary skill in the art, to which the present invention pertains, from the following description.

BEST MODE

Figure 1:
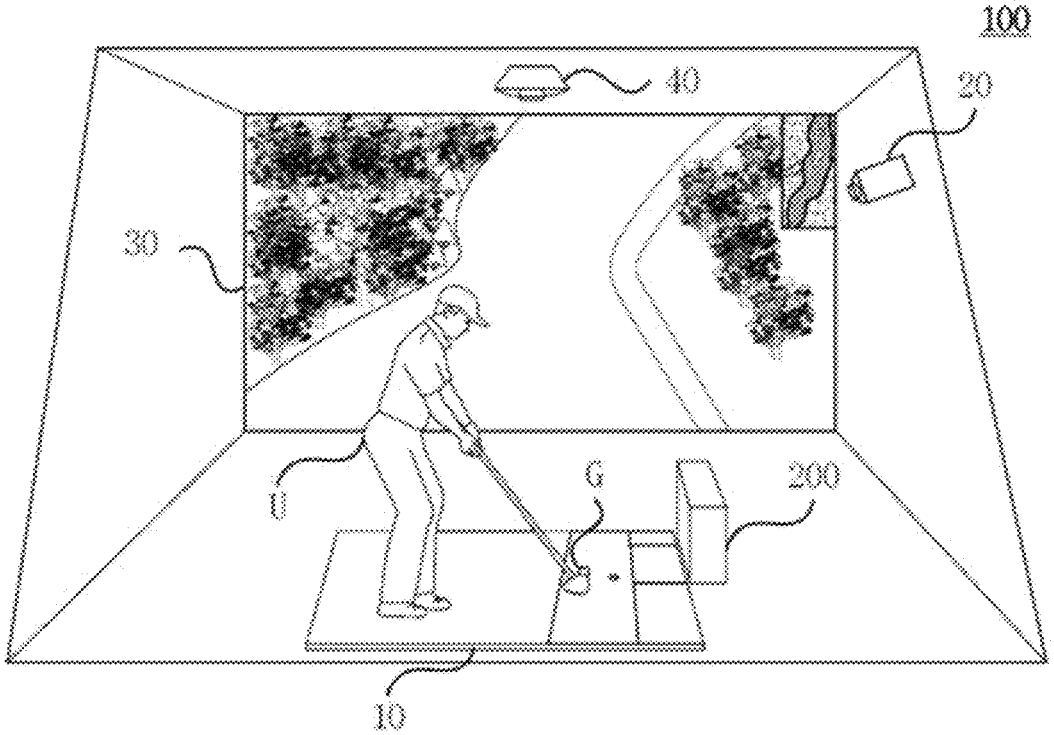
FIG. 1 is a diagram showing a screen golf system in which a virtual golf simulation device according to an embodiment disclosed herein is implemented.

As a technical solution for overcoming the above technical problems, according to an embodiment described therein, there is provided a virtual golf simulation device for simulating the movement of a ball on a virtual golf course, the virtual golf simulation device including: a memory configured to store a hardness value indicative of the degree of hardness of a terrain in the virtual golf course; and an image processor configured to simulate the movement trajectory of a ball on the virtual golf course based on shot data on a user's golf shot and the hardness value.

Furthermore, as a technical solution for overcoming the above technical problems, according to an embodiment described therein, there is provided a virtual golf simulation method by which a virtual golf simulation device simulates the movement of a ball on a virtual golf course, the virtual golf simulation method including: storing a hardness value indicative of the degree of hardness of a terrain in the virtual golf course; and simulating the movement trajectory of a ball on the virtual golf course based on shot data on a user's golf shot and the hardness value.

MODE FOR INVENTION

Various embodiments will be described in detail below with reference to the accompanying drawings. The following embodiments may be modified to various different forms and then practiced. In order to more clearly illustrate features of the embodiments, detailed descriptions of items that are well known to those having ordinary skill in the art to which the following embodiments pertain will be omitted.

Furthermore, in the drawings, portions unrelated to descriptions of the embodiments will be omitted. Throughout the specification, like reference symbols will be assigned to like portions.

Throughout the specification, when one component is described as being 'connected' to another component, this includes not only a case where the one component is 'directly connected' to the other component but also a case where the one component is 'connected to the other component with a third component arranged therebetween.' Furthermore, when one portion is described as 'including' one component, this does not mean that the portion does not exclude another component but means that the portion may further include another component, unless explicitly described to the contrary.

Embodiments of the present invention will be described in detail below with reference to the accompanying drawings.

Figure 2:
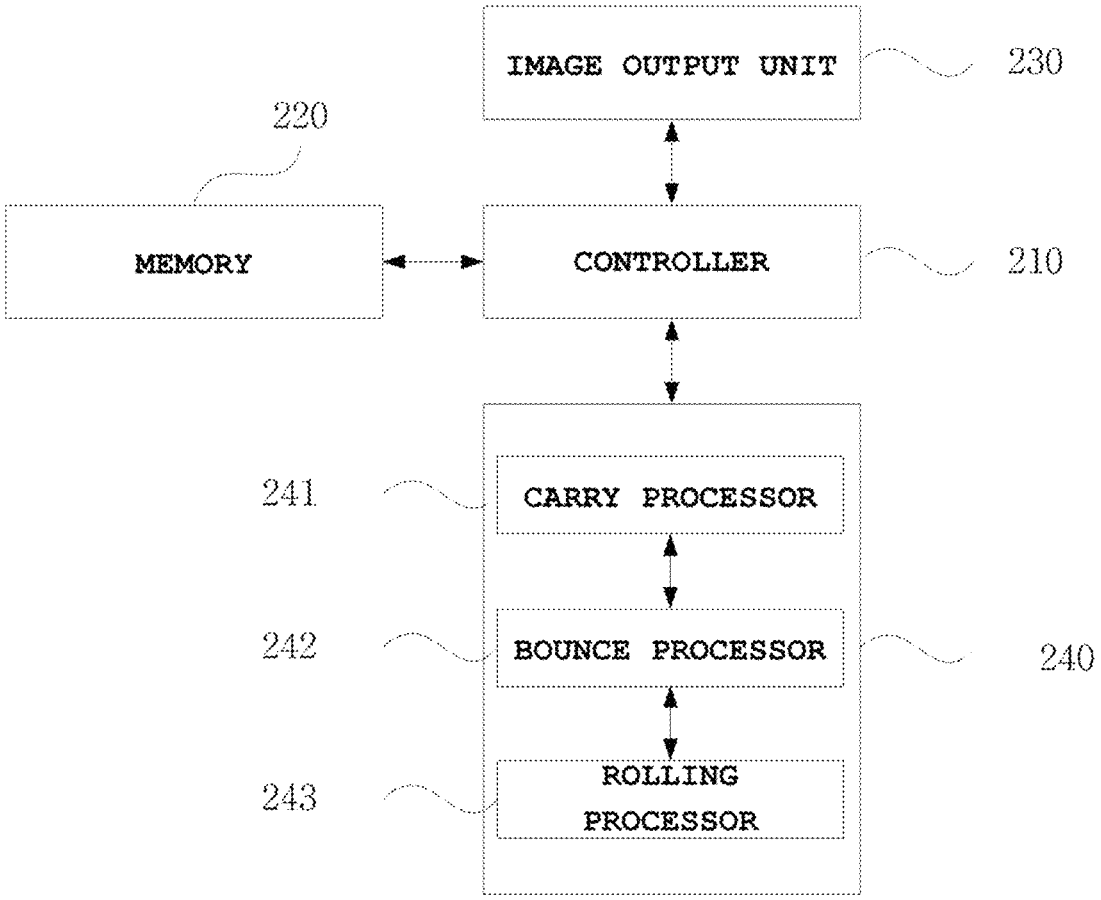
FIG. 2 is a block diagram showing the configuration of the virtual golf simulation device according to the embodiment disclosed herein.

FIG. 1 is a diagram showing a screen golf system in which a virtual golf simulation device according to an embodiment disclosed herein is implemented, FIG. 2 is a block diagram showing the configuration of the virtual golf simulation device, and FIGS. 3 to 10 are exemplary diagrams illustrating the virtual golf simulation device according to the embodiment disclosed herein.

As shown in FIG. 1, a screen golf system 100 according to an embodiment described therein includes: a swing plate 10 configured such that a user U can hit a golf ball G thereon; a sensing device 20 configured to detect the movement of at least one of the user U, the golf ball G, and a golf club; an image output device 40 configured to output a predetermined image to a screen 30 provided on the front side; and a virtual golf simulation device 200 configured such that all types of data required for virtual golf simulation are stored and processed therein.

The virtual golf simulation device 200 according to the embodiment described therein stores all types of data required for virtual golf simulation, and processes all images related to virtual golf simulation, such as an image of a virtual golf course and an image of the movement of a golf ball. In addition, images processed by the virtual golf simulation device 200 are displayed on the screen 30.

Accordingly, when the user U hits the golf ball G toward the screen 30 on the swing plate 10, the sensing device 20 may sense it and transfer it to the virtual golf simulation device 200, and the virtual golf simulation device 200 may simulate a virtual ball trajectory on a virtual golf course based on the movement of at least one of the user U, the golf ball G, and the golf club. In other words, the virtual golf simulation device 200 may construct golf simulation image information, such as an image of the movement of a ball on a virtual golf course, by taking into consideration the characteristics of the movement of an actual golf ball, and may project the golf simulation image information onto the screen 30 through the image output device 40 implemented as a projector or the like, thereby allowing a golf game to be played through simulation.

In addition, the virtual golf simulation device 200 operates to process all complicated manipulations for virtual golf simulation. For example, the virtual golf simulation device 200 may allow a user to log in for virtual golf simulation or to manipulate a simulation environment in response to the acquisition of a manipulation command. Accordingly, the virtual golf simulation device 200 may receive the input of settings related to environmental data, such as a hardness value or the like, from a user.

Meanwhile, the sensing device 20 according to an embodiment is a device that acquires an image of a situation in which the golf ball G is hit by the golf club in a hitting area while monitoring the hitting area, i.e., a predetermined area where the golf ball G is placed and hit by the golf club in the swing plate 10, and senses the movement of at least one of the user U, the golf ball G, and the golf club from the image.

The sensing device 20 may be provided as an imaging device such as a vision sensor that takes an image of the hitting area. In connection with this, although the sensing device 20 is shown as being installed on a wall of the screen golf system in FIG. 1, the sensing device 20 may be implemented as a sensor installed on the ceiling of the screen golf system and a sensor installed on a side wall of the screen golf system. Alternatively, the sensing device 20 may be implemented on the virtual golf simulation device 200. For example, when the sensing device 20 is implemented as two vision sensors, the two vision sensors may monitor the hitting area in an overlapping manner. This is an example, but the sensing device 20 is not necessarily limited to this and includes cases in which two or more vision sensors are installed. The location where the vision sensor is installed may include all cases where the vision sensor is installed anywhere in the booth of the screen golf system as well as the ceiling or wall.

As the sensing device 20 detects the movement of at least one of the user, the golf ball and the golf club, the sensing device 20 calculates sensing information such as movement parameters for the movement of the golf ball, and transfers the sensing information to the virtual golf simulation device 200. The virtual golf simulation device 200 may calculate shot data from the sensing information.

Although the virtual golf simulation device 200 according to the embodiment described herein has been described as being applied to the screen golf system 100 in detail, the application thereof is not necessarily limited to the screen golf system 100, but it may be applied to all types of systems or devices in which a virtual golf course is simulated and imaged and an image of the movement of a virtual ball is simulated.

Meanwhile, as shown in FIG. 2, the virtual golf simulation device 200 may include a controller 210, a memory 220, an image output unit 230, and an image processor 240.

The controller 210 may control the overall operation of the virtual golf simulation device 200, and may include a processor such as a CPU.

For example, the controller 210 may execute a program stored in the memory 220, may read a file stored in the memory 220, or may store a new file in the memory 220.

In contrast, various types of data such as files, applications, and programs may be installed and stored in the memory 220. For example, a program for performing a virtual golf simulation method may be installed in the memory 220. Accordingly, the controller 210 may perform a virtual golf simulation method by executing the program stored in the memory 220.

The memory 220 stores all types of data required to implement images of virtual golf simulation. For example, the memory 220 may store data related to a virtual golf course implemented by visualizing an actual golf course.

For example, the memory 220 may store a 'hardness value' indicative of the hardness of a terrain in a virtual golf course. In this case, the 'hardness value' may increase as the hardness increases, and may decrease as the hardness increases.

To this end, the memory 220 may be configured to receive various types of data related to a virtual golf course from a server (not shown) over a network and to temporarily store them.

Furthermore, the memory 220 may be configured to receive sensing information such as movement parameters related to the movement of a golf ball from the sensing device 20 and to temporarily store it.

Meanwhile, the image output unit 230 projects a simulation image, processed by the image processor 240, onto the screen 30 through the image output device 40 so that the user can view the image.

In this case, the image processor 240 may perform information processing to implement an image related to a virtual golf course using the data related to the virtual golf course stored in the memory 220, and may simulate and implement the ball movement trajectory of the golf ball G, hit by the user, on the virtual golf course as an image.

According to an embodiment, the image processor 240 may visualize the environment of a golf course according to environment data and provide it.

In this case, the 'environmental data' refers to a factor that affects a result obtained by simulating the movement of a golf ball in a virtual golf course, but is a value that cannot be calculated based on a user's golf shot. In other words, the environment data is a value indicative of the environment of a virtual golf course where a user has made a golf shot, and includes, for example, the terrain data and non-terrain data of a virtual golf course. In this case, the 'terrain data' may include a hardness value indicative of the degree of hardness of a terrain, a slope value indicative of the slope of the terrain, a green speed value indicative of the speed of a green according to the condition of the grass of the terrain, and/or the like. The 'non-terrain data' may include, for example, season, weather, temperature, humidity, wind speed, wind direction, and/or the like.

The virtual golf simulation device 200 may set environmental data in various manners to support various environments for a user.

In this case, the environment data may be preset. For example, the hardness value may have a preset value for each terrain. However, the environment data may be set by receiving input from a user or administrator. To this end, the image processor 240 may further include an interface unit (not shown).

Figure 3:
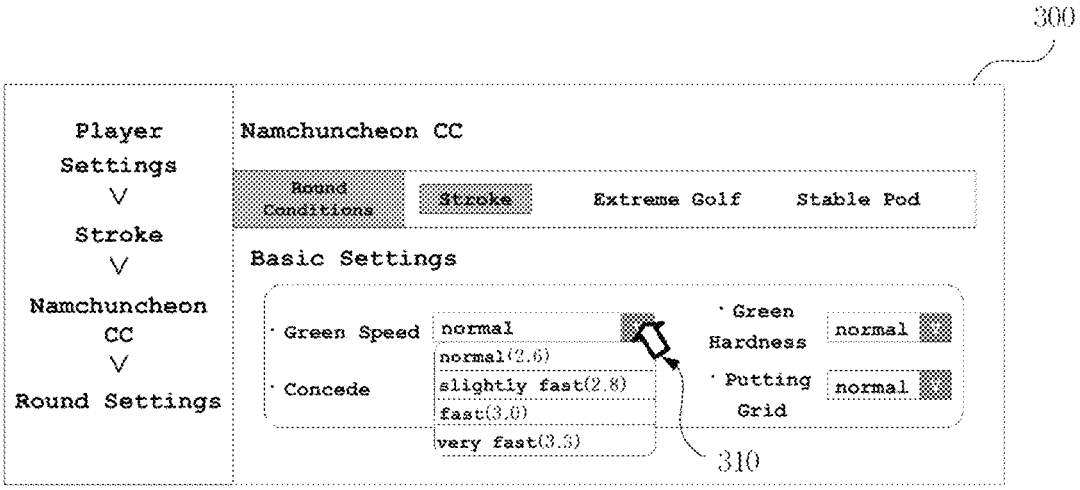
FIGS. 3 to 10 are exemplary diagrams illustrating the virtual golf simulation device according to the embodiment disclosed herein.

In connection with this, as shown in FIG. 3, the interface unit (not shown) may provide a user or administrator with an input interface 300 for allowing environment data, such as 'green speed', 'concede,' green hardness,' and 'putting grid,' to be input. The environment data may be set according to a value input through the interface 300.

To this end, for example, the interface unit (not shown) allows 'green speed' to be set using only a few clicks. Accordingly, a user may rapidly and easily set the degree of 'green speed' only by manipulating a cursor 310 or making touches, and may then perform golf play accordingly.

Similarly, the interface unit (not shown) may have a hardness value selected through an interface for displaying a plurality of hardness values. For example, when a user sets 'normal,' which was set by default for 'green hardness,' to 'hard,' the image processor 240 may perform processing such that the bounce distance and the rolling distance are changed according to a hardness value corresponding to 'hard.'

In addition, the hardness value may be changed based on at least one of weather, season, temperature, humidity, and time when a user's golf shot is made. For example, the hardness value may be set to different values for winter and summer, respectively.

Furthermore, the hardness value may be changed according to the information of a golf ball used for a user's golf shot. The 'information of a golf ball' includes information about the manufacturer, brand, and specifications of the corresponding golf ball. Accordingly, even for the same terrain, the hardness value may be set differently depending on the brand of a golf ball used by a user. For example, even in the case where the hardness value for a hard terrain is set to a predetermined value, when it is determined that a golf shot is made with a golf ball of a brand having relatively low hardness or elasticity, the hardness value may be adjusted to have the same hardness value as that of a normal terrain.

According to another embodiment, the image processor 240 may calculate the movement trajectory of a ball on a virtual golf course. In this case, the 'movement trajectory' refers to a result obtained by simulating the movement of the ball on the virtual golf course as a user hits the golf ball. The movement trajectory is represented by a form in which the ball moves on the virtual golf course, by a form obtained by connecting the traces of the movement of the ball on the virtual golf course with lines, or by text, image, voice, or video indicative of a driving distance value.

The image processor 240 may include a carry processor 241, a bounce processor 242, and a rolling processor 243.

In other words, the driving distance is composed of carry, bounce, and rolling. According to one embodiment, the distance from the spot where a ball starts to travel in the air to the spot where it lands on the ground for the first time on a virtual golf course is referred to as 'carry,' the distance along which the ball moves while bouncing after the first landing on the ground is referred to as 'bounce,' and the distance along which the ball moves while rolling on the ground after the bounce until it finally stops is referred to as 'rolling.'

Accordingly, the image processor 240 processes the driving distance of a ball after a user's shot. To this end, the image processor 240 may use the processing results of the carry processor 241, the bounce processor 242, and the rolling processor 243.

For example, the image processor 240 may process the movement of the ball on the virtual golf course based on the carry distance, the bounce distance, and the rolling distance processed by the carry processor 241, the bounce processor 242, and the rolling processor 243, respectively.

Meanwhile, the carry processor 241 may calculate the carry distance of the ball on the virtual golf course.

According to an embodiment, the carry processor 241 may simulate a carry distance by simulating a plurality of factors.

In this case, each of the 'factors' is an element that affects a result obtained by simulating the movement of a ball on a virtual golf course. According to one embodiment, the factors may be composed of shot data and environment data.

The shot data may be calculated by the carry processor 241 from sensing information, and may include ball speed, direction angle, launch angle, backspin, and sidespin.

The carry processor 241 may calculate a carry distance by simulating shot data, and may calculate a carry distance by additionally simulating environment data in a virtual golf course.

Accordingly, the carry processor 241 may simulate environment data and shot data together during the simulation of a carry distance according to a user's golf shot while visualizing the environment of a golf course according to the environment data and providing it. The carry processor 241 may visualize the simulated carry distance and project the simulated carry distance onto the screen 40 through the image output unit 230.

In contrast, the bounce processor 242 may calculate the bounce distance of a ball on the virtual golf course.

In other words, the bounce processor 242 may calculate a bounce distance, which is the distance along which a ball moves while bouncing on the virtual golf course, and may visualize the bouncing of the ball and project the visualized bouncing onto the screen 40 through the image output unit 230.

According to an embodiment, the bounce processor 242 may simulate the movement trajectory of a ball based on the hardness value of a terrain and shot data.

For example, when a movement vector when a ball having moved according to shot data first collides with the ground is obtained, the bounce processor 242 may simulate the movement trajectory of the ball by using the movement vector and a hardness value.

According to another embodiment, the bounce processor 242 may simulate the movement trajectory of a ball based on the hardness value of a terrain when the ball collides with the ground after the carry of the ball and shot data.

For example, when a movement vector obtained when a ball having moved according to shot data first collides with the ground is obtained, the bounce processor 242 may simulate the movement trajectory of the ball by using the hardness value of the land with which the ball collided and the movement vector.

Accordingly, for example, the bounce processor 242 may simulate the movement trajectory of a ball by calculating a movement vector based on shot data applied to a ball according to the hardness value of a green when the ball collides within the boundary of the green after the carry of the ball.

In contrast, according to an embodiment, the bounce processor 242 may process a plurality of bounces on the virtual golf course.

In this case, the 'bounce' refers to the distance from the spot where the ball collides with the ground to the spot where it bounces and collides with the ground next. Accordingly, for example, in a virtual golf course, a ball may bounce multiple times instead of only once, so that the bounce processor 242 may process multiple bounces. For example, the bounce processor 242 may calculate a bounce distance for each bounce and process the movement trajectory of the ball according to the bounce for each bounce.

To this end, the bounce processor 242 may calculate a vector value for the next bounce.

According to an embodiment, the bounce processor 242 may correct out-speed based on the hardness value.

In this case, 'out_speed' is the speed obtained immediately after a ball having bounced in a current bounce collides with the ground. For example, it may be the speed when a ball collides with the ground for the next bounce. A vector value in the next bounce may be determined based on the out-speed.

For example, the bounce processor 242 may correct the out-speed in the last bounce (the bounce immediately before the rolling of a ball). When it is determined that the hardness value is changed from 'normal' to 'hard,' the out-speed in the last bounce, i.e., each of the vector value in the x-axis direction and the vector value in the y-axis direction, may be multiplied by 1.1 times. In this manner, when correction is performed in the direction in which the out-speed in the last bounce increases, the rolling processor 243 may increase the rolling speed and increase the rolling distance accordingly.

According to another embodiment, the bounce processor 242 may change the x-axis value and y-axis value of a movement direction vector when the z-axis value of the movement direction vector is changed based on an elasticity value during a bounce.

For example, the bounce processor 242 may double an x-axis value and a y-axis value when a z-axis value in a current bounce is changed, or may increase an x-axis value and a y-axis value in a movement vector for the next bounce when a z-axis value in the next bounce is changed.

Figure 4:
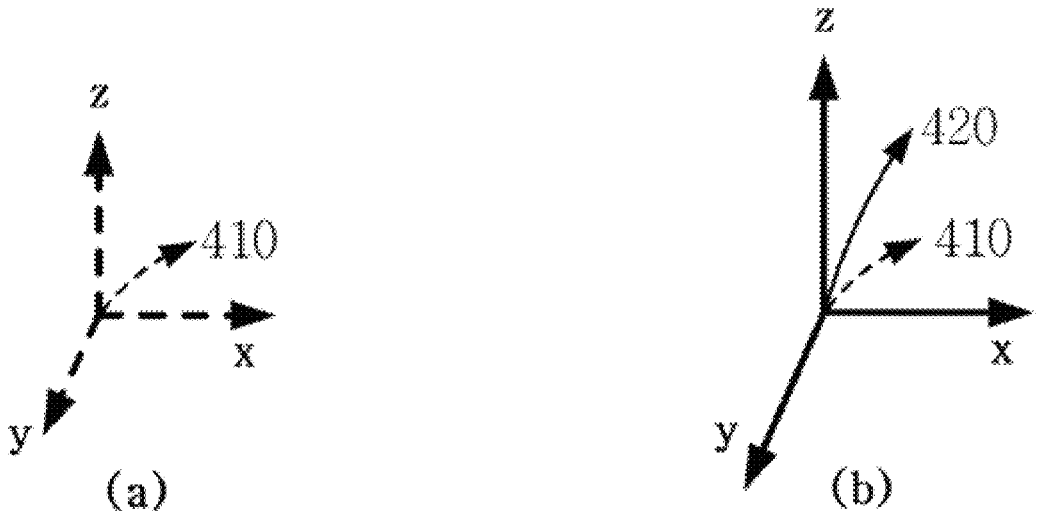

In connection with this, as shown in FIG. 4(*a*), a movement direction vector 410 upon bouncing may be decomposed into x-axis, y-axis, and z-axis values. When the z-axis value is changed based on an elasticity value, the x-axis value and the y-axis value are also increased such that a movement direction vector 420 can be increased as shown in FIG. 4(*b*).

Meanwhile, according to another embodiment, the bounce processor 242 may adjust a clamp range based on the hardness value and calculate an out-speed based on the adjusted clamp range.

In other words, since a maximum limit value and a minimum limit value are set for the bounce damping rate used to calculate the out-speed, the bounce damping rate may be determined to be only a value between the maximum limit value and the minimum limit value. For example, when it is determined that the hardness value is changed, the bounce processor 242 may increase the height and distance in the next bounce by changing the maximum limit value. In this case, the 'bounce damping rate' refers to the ratio regarding a value in the case of colliding for a current bounce and a value in the case of bouncing for the next bounce.

Figure 5:
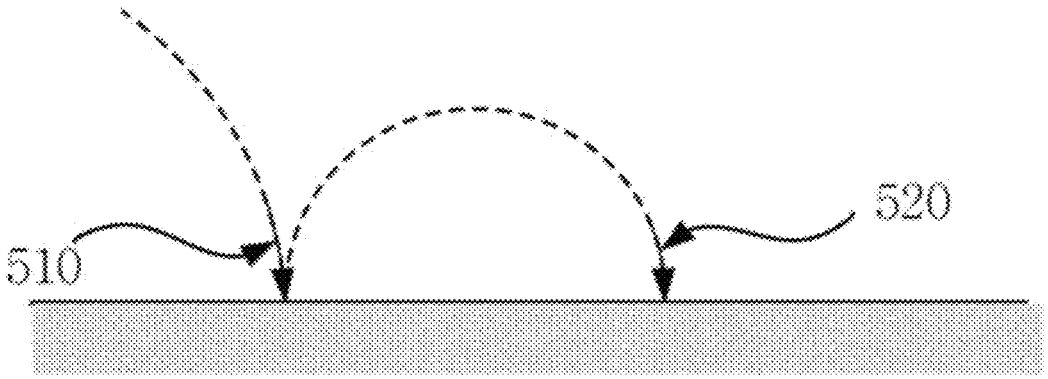

In connection with this, as shown in FIG. 5, the bounce damping rate, which is the ratio regarding a value 510 in the case of colliding for a current bounce and a value 520 in the case of bouncing for the next bounce, is determined to be a value between the maximum limit value and the minimum limit value. By increasing the maximum limit value, the bounce damping rate may become higher than before the adjustment of the clamp range.

For example, the bounce processor 242 may increase a value that is currently set as the maximum limit value, which is a maximum permissible value when a ball bounces on a green terrain. For example, when a value currently set as the maximum limit value is 0.75, the bounce processor 242 may adjust the maximum limit value to 0.9 by adding 0.15. Accordingly, the maximum bounce height of a ball may be allowed to be higher.

Accordingly, for example, the bounce processor 242 may set a minimum limit value and a maximum limit value so that a ball may bounce at a height between the minimum limit value and the maximum limit value upon bouncing.

Accordingly, for example, the bounce processor 242 may set the bounce damping rate of a ball to the minimum limit value when the bounce damping rate of the ball is lower than the minimum limit value upon bouncing of the ball, may set a value between the minimum limit value and the maximum limit value as the bounce damping rate of a ball when the bounce damping rate of the ball is calculated as the corresponding value upon bouncing of the ball, and may set the bounce damping rate of a ball to the maximum limit value when the bounce damping rate of the ball is higher than the maximum limit value upon bouncing of the ball.

This bounce damping rate may affect the speed damping value, which will be described in detail below.

Meanwhile, according to another embodiment, the bounce processor 242 may correct the z-axis value of the next bounce vector based on a hardness value.

To this end, the bounce processor 242 may update an elasticity value for each bounce.

In this case, the elasticity value is a factor that affects the speed damping value to be described later. As the elasticity value is updated, the out-speed is changed. In other words, the out-speed inevitably decreases according to the law of conservation of momentum upon transition from a current bounce to the next bounce. For example, as the bounce processor 242 increases the elasticity value, the degree of decrease in out-speed may decrease.

When updating the elasticity value, the bounce processor 242 may double the elasticity value upon first bouncing, i.e., upon first colliding, as an example. For example, the elasticity value may be updated by multiplying the value, set as the elasticity value, by 1.25 times.

Furthermore, when updating the elasticity value, the bounce processor 242 may double the elasticity value upon colliding for every bounce as an example. For example, the bounce processor 242 may update the elasticity value by multiplying the value, set as the elasticity value, by 1.5 times.

Through this, all bounces, including a first bounce, may be enhanced.

Meanwhile, the bounce processor 242 may adjust elastic modulus.

In this case, the elastic modulus is a factor that affects the speed damping value to be described later. As the elastic modulus is updated, the out-speed is changed.

For example, when a ball collides with a green, the bounce processor 242 may decrease the elastic modulus more than when a collision target terrain is not a green. The bounce processor 242 may change the elastic modulus by, for example, 0.7 times. Accordingly, when a ball collides with a green, the bounce processor 242 may decrease the elastic modulus.

Meanwhile, the bounce processor 242 may calculate a speed damping value based on at least one of the bounce damping rate, the elasticity value, and the elastic modulus.

In other words, the bounce processor 242 may determine the bounce damping rate based on the hardness value. According to Equation 3 to be described later, the speed damping value may be calculated based on the bounce damping rate. Furthermore, the bounce processor 242 may simulate the movement trajectory of a ball by adjusting an out-speed according to the determined speed damping value, e.g., according to Equation 2 and correcting the z value of a bounce vector calculated according to the out-speed.

The bounce processor 242 may calculate a current moving direction scalar value and an out direction scalar value.

In other words, the bounce processor 242 may obtain a current direction scalar value by the scalar multiplication of a current moving direction vector by the normal vector of a collision target terrain. In this case, the current moving direction vector refers to a vector immediately after the collision of the ball with the ground in a current bounce.

In addition, the bounce processor 242 may obtain an out direction scalar value by the scalar multiplication of an out direction vector by the normal vector of the collision target terrain. In this case, the out direction refers to a vector immediately after the collision of the ball with the ground for the bounce next to the current bounce.

First, the bounce processor 242 may obtain the bounce damping rate r according to Equation 1:

$$r=B/A(\text{however, when } B/A \text{ is greater than } 1, r=A/B) \quad (1)$$

where A is a scalar value corresponding to a current direction and B is a scalar value corresponding to an out direction.

Additionally, the bounce damping rate may be adjusted based on the hardness value. In this case, the bounce damping rate r adjusted according to the hardness value may be recalculated depending on whether the length of the current movement vector of the ball exceeds a predetermined value.

Thereafter, the bounce processor 242 may obtain an out-speed (out_speed) indicative of a forward speed upon next bouncing according to Equation 2:

$$\text{out_speed}^*=spd_\text{damp} \quad (2)$$

In this equation, spd_damp is a speed damping value, which may be obtained according to Equation 3 below:

$$spd_\text{damp}=r^*(e^*\text{elascity_factor}+1-\text{elascity_factor}) \quad (3)$$

where r denotes the bounce damping rate, e denotes the elasticity value, and the elascity_factor denotes the elastic modulus.

For example, the speed damping value spd_damp calculated according to Equation 3 may be set as the speed damping value and used in Equation 2 when the corresponding value is within a predetermined range, may be set as the minimum value of the predetermined range and used in Equation 2 when it is outside the predetermined range and less than the predetermined range, and may be set to the maximum value of the predetermined range and used in Equation 2 when it is outside the predetermined range.

Accordingly, as described in Equation 2, the out-speed out_speed may be adjusted by multiplying the existing out-speed out_speed by the speed damping value spd_damp.

According to the out-speed calculated as described above, the bounce processor 242 may calculate a vector value in the next bounce, and the z-direction value of the vector value may be calculated. Accordingly, the z-direction value may be increased.

According to the hardness value, the bounce processor 242 may correct the z-direction value of the vector value in the next bounce, thereby simulating a realistic ball movement trajectory.

Figure 6:
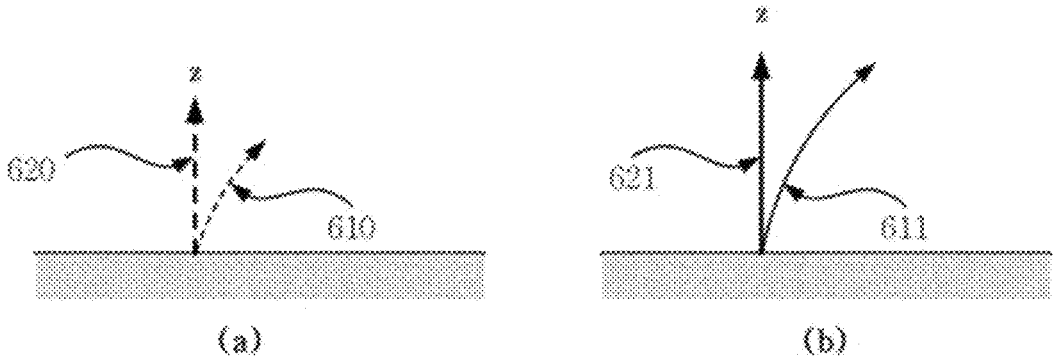

In other words, as shown in FIG. 6, according to the calculated out-speed, the bounce processor 242 calculates a vector 610 in the next bounce as shown in FIG. 6(*a*), calculates a z-direction value 620 accordingly, and obtains an increased vector 611 according to the z-direction value 621 obtained by increasing the calculated z-direction value 620 as shown in FIG. 6(*b*), thereby implementing a bounce to be similar to a bounce on an actual golf course.

Meanwhile, the rolling processor 243 may calculate a rolling distance on a virtual golf course.

According to an embodiment, the rolling processor 243 may calculate a rolling distance, which is the distance along which a ball rolls on a virtual golf course after the last bounce, and may also visualize a ball rolling on the floor and project it onto the screen 40 through the image output unit 230.

The rolling processor 243 may calculate the rolling distance based on the out-speed calculated by the bounce processor 242.

Accordingly, when the out-speed is adjusted and calculated by the bounce processor 242 based on the hardness value, the rolling processor 243 may change the rolling distance according to the adjusted out-speed.

For example, the rolling processor 243 determines the moving speed of a ball according to the out-speed, and may determine the rolling distance by taking into consideration the inclination of a terrain and the speed of a green. Accordingly, for example, when the hardness of the terrain is high, the rolling distance may be increased.

By calculating the driving distance of a ball according to carry, bounce and rolling and also visualizing it and projecting it onto the screen 40 through the image output unit 230 as described above, the image processor 240 may simulate and provide the movement of the ball on a virtual golf course according to a user's golf shot.

In this regard, FIGS. 7 to 10 are intended to illustrate the virtual golf simulation device, and show situations in which simulated virtual golf images are displayed on a screen.

Figure 7:
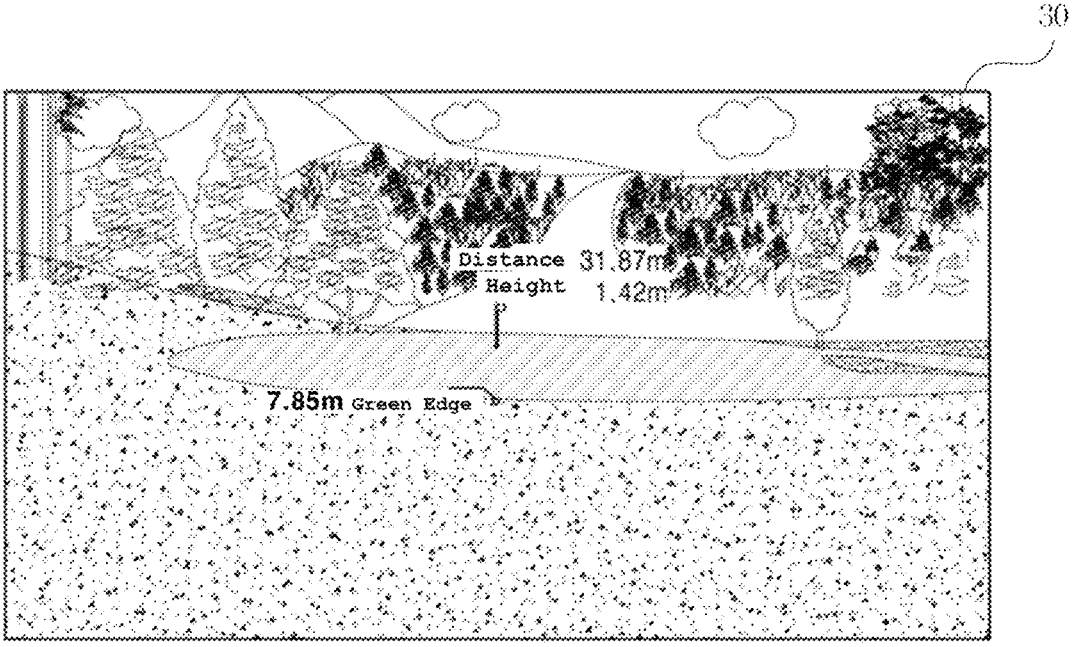

As shown in FIG. 7, a simulation image when a user views a target point from the location where a golf shot is made may be displayed on the screen 30.

In addition, as a user's golf shot is made, the virtual golf simulation device 200 may simulate the movement trajectory of a ball on a virtual golf course based on shot data and a hardness value.

Figure 8:
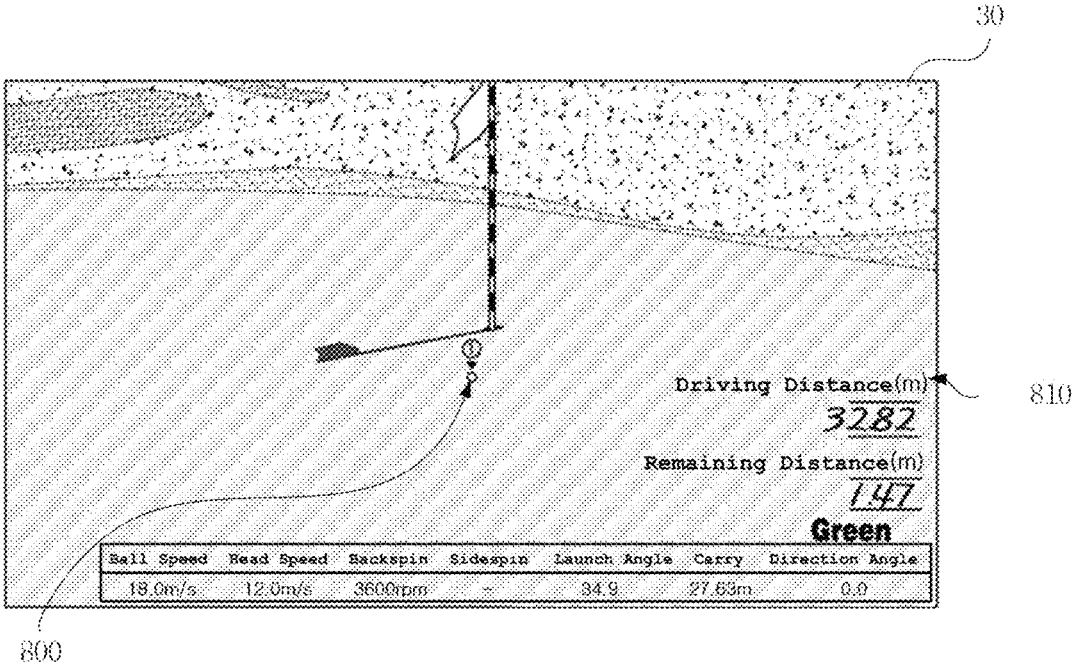

In FIG. 8, the final landing of a ball 800 when the hardness of the green is 'normal' is displayed through the screen 30, and a corresponding driving distance 810 may also be provided to a user.

Figure 9:
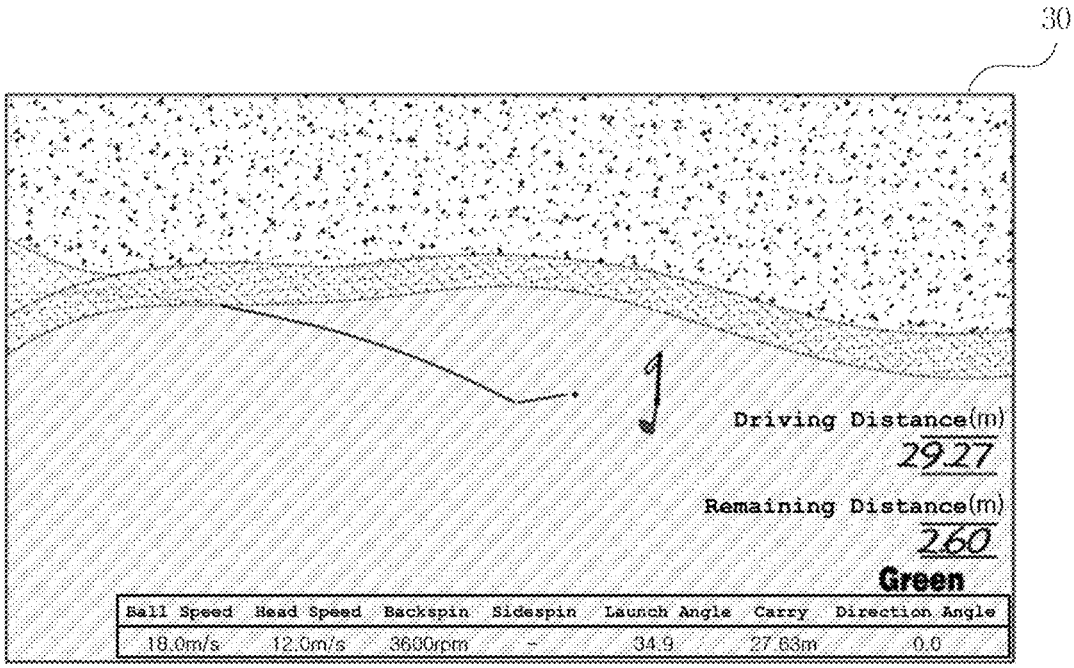
Figure 10:
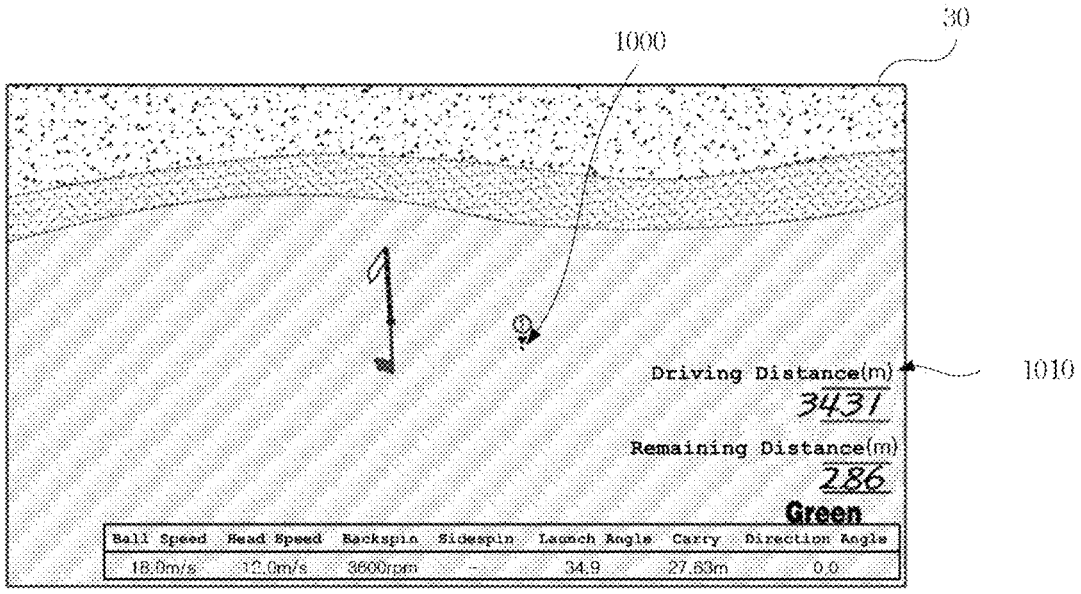

In contrast, in FIG. 9, the moving of a ball when the hardness of a green is 'hard' is shown, and in FIG. 10, the final landing of the ball is displayed through the screen 30. Even when simulation is performed based on the same shot data (ball speed, head speed, backspin, etc.) from the same starting point as shown in FIG. 7, it can be seen that when there is a difference in hardness, the position where a ball 1000 is landed and a corresponding driving distance 1010 become different from the position and driving distance 810 of the ball 800 shown in FIG. 8.

Figure 11:
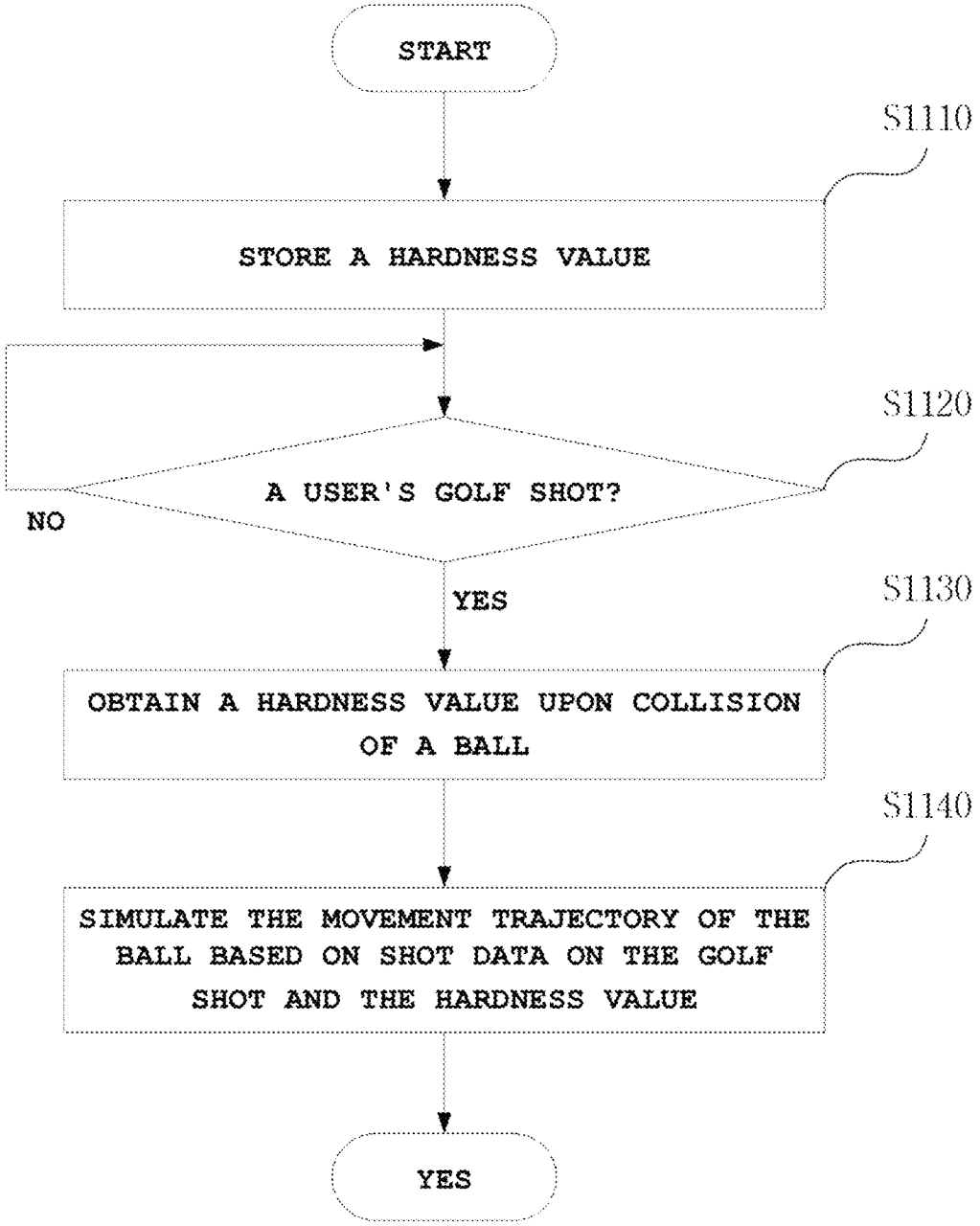
FIG. 11 is a flowchart illustrating a virtual golf simulation method according to an embodiment disclosed herein.

Meanwhile, FIG. 11 is a flowchart illustrating a virtual golf simulation method according to an embodiment. The virtual golf simulation method shown in FIG. 11 includes steps that are performed in a time-series manner by the virtual golf simulation device 200 described with reference to FIGS. 1 to 10. Accordingly, the descriptions that are omitted below but have been given above in conjunction with the virtual golf simulation device 200 shown in FIGS. 1 to 10 may also be used in the virtual golf simulation method according to the embodiment shown in FIGS. 11 and 12.

The virtual golf simulation device 200 may store the hardness value in step S1110.

In this case, the virtual golf simulation device 200 may have a hardness value selected through the interface for displaying a plurality of hardness values, and may set the selected hardness value.

In addition, when a user's golf shot is detected in S1120, the virtual golf simulation device 200 may obtain a hardness value upon collision of a ball in step S1130.

In other words, the virtual golf simulation device 200 may obtain the hardness value of a terrain when the ball first collides with the ground after carry.

In this case, for example, the virtual golf simulation device 200 may adjust the hardness value based on golf ball information. Alternatively, for example, the virtual golf simulation device 200 may adjust the hardness value based on at least one of weather, season, temperature, humidity, and time at the time when the user's golf shot is made.

In addition, the virtual golf simulation device 200 may simulate the movement trajectory of the ball based on the hardness value and shot data in step S1140.

According to an embodiment, the virtual golf simulation device 200 may correct the out-speed in the last bounce of the ball based on the hardness value, and may calculate a rolling distance based on the corrected out-speed.

According to another embodiment, the virtual golf simulation device 200 may change the x-direction value and y-direction value of a bounce vector when the z-direction value of the bounce vector is changed based on an elasticity value.

According to another embodiment, the virtual golf simulation device 200 may simulate the movement trajectory of the ball by adjusting the clamp range of the bounce damping rate based on the hardness value and calculating the out-speed based on the bounce damping rate in the adjusted clamp range.

According to another embodiment, the virtual golf simulation device 200 may simulate the movement trajectory of the ball by correcting the z-direction value of the vector for the next bounce based on the hardness value.

According to another embodiment, the virtual golf simulation device 200 may determine a bounce damping rate based on the hardness value, calculates a speed damping value based on the bounce damping rate and applies it to an out-speed in the next bounce, calculate a vector in the next bounce based on the out-speed, and correct the z-direction value of the vector, thereby simulating the movement trajectory of the ball.

According to another embodiment, the virtual golf simulation device 200 may simulate the movement trajectory of the ball by correcting the height and distance in the next bounce based on the hardness value.

As the hardness of the terrain becomes harder, the elasticity of the terrain increases, and thus the bouncing force of the ball increases, so that the bouncing height of the ball rises. Accordingly, the angle at which the ball collides with the ground is bound to increase. As the angle of the collision increases, the out-speed decreases. As a result, there is a problem in that the force in the x-axis or the y-axis decreases, so that the force in the x-axis or y-axis in the last bounce decreases, with the result that the rolling distance also decreases accordingly.

Figure 12:
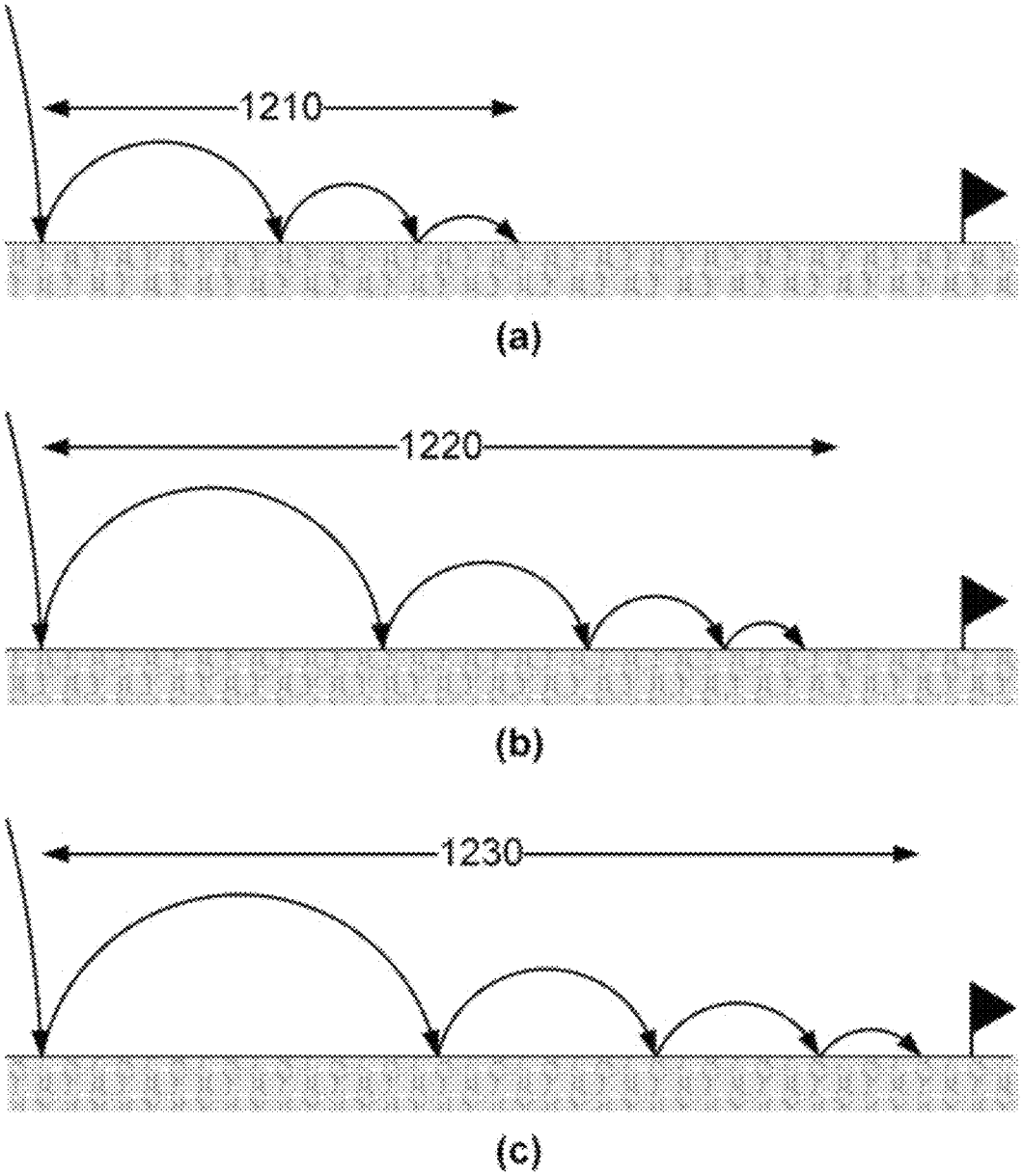
FIG. 12 is an exemplary diagram illustrating the virtual golf simulation method according to the embodiment disclosed herein.

In connection with this, each of FIGS. 12(*a*) to 12(*c*) shows a situation in which a ball bounces after first collision with the ground according to carry. In FIG. 12(*a*), there are shown the height and distance at and over which the ball bounces when the hardness of a green is 'normal.' In FIGS. 12(*b*) and 12(*c*) show the height and distance at and over which the ball bounces when the hardness of a green is 'hard.'

As shown in FIG. 12(*a*), when the hardness of the green is 'normal,' the ball may move by a bounce distance 1210 while bouncing in the directions of the arrows.

Meanwhile, in the case where the out-speed is not increased even when the hardness of the green is 'hard,' the ball bounces and moves by a bounce distance 1220, as shown in FIG. 12(*b*). According to the virtual golf simulation method disclosed herein that allow the ball to bounce while increasing the out-speed, the ball moves farther than the bounce distance 1220 and moves by a bounce distance 1230 as shown in FIG. 11(*c*), and the out-speed in the last bounce is also higher than that of FIG. 12(*b*), with the result that the rolling distance may also be increased.

In the case where the hardness of a green is hard when a golf shot is actually made, it is natural that as the bounce height increases, the bounce distance or rolling distance increases. When the movement trajectory of a ball is simulated as described above, it may be possible to overcome the problem in which as the collision angle increases, the rolling distance decreases. Therefore, a more realistic virtual golf simulation image may be provided.

The virtual golf simulation method described above may also be implemented in the form of a computer-readable medium that stores instructions and data that can be executed by a computer. In this case, the instructions and the data may be stored in the form of program code, and may generate a predetermined program module and perform a predetermined operation when executed by a processor. Furthermore, the computer-readable medium may be any type of available medium that can be accessed by a computer, and may include volatile, non-volatile, separable and non-separable media. Furthermore, the computer-readable medium may be a computer storage medium. The computer storage medium may include all volatile, non-volatile, separable and non-separable media that store information, such as computer-readable instructions, a data structure, a program module, or other data, and that are implemented using any method or technology. For example, the computer storage medium may be a magnetic storage medium such as an HDD, an SSD, or the like, an optical storage medium such as a CD, a DVD, a Blu-ray disk or the like, or memory included in a server that can be accessed over a network.

The virtual golf simulation method described above may be implemented as a computer program (or a computer program product) including computer-executable instructions. The computer program includes programmable machine instructions that are processed by a processor, and may be implemented as a high-level programming language, an object-oriented programming language, an assembly language, a machine language, or the like. Furthermore, the computer program may be stored in a tangible computer-readable storage medium (for example, memory, a hard disk, a magnetic/optical medium, a solid-state drive (SSD), or the like).

The virtual golf simulation method described above may be implemented in such a manner that the above-described computer program is executed by a computing device. The computing device may include at least some of a processor, memory, a storage device, a high-speed interface connected to memory and a high-speed expansion port, and a low-speed interface connected to a low-speed bus and a storage device. These individual components are connected using various buses, and may be mounted on a common motherboard or using another appropriate method.

In this case, the processor may process instructions within a computing device. An example of the instructions is instructions which are stored in memory or a storage device in order to display graphic information for providing a Graphic User Interface (GUI) onto an external input/output device, such as a display connected to a high-speed interface. As another embodiment, a plurality of processors and/or a plurality of buses may be appropriately used along with a plurality of pieces of memory. Furthermore, the processor may be implemented as a chipset composed of chips including a plurality of independent analog and/or digital processors.

Furthermore, the memory stores information within the computing device. As an example, the memory may include a volatile memory unit or a set of the volatile memory units. As another example, the memory may include a non-volatile memory unit or a set of the non-volatile memory units. Furthermore, the memory may be another type of computer-readable medium, such as a magnetic or optical disk.

In addition, the storage device may provide a large storage space to the computing device. The storage device may be a computer-readable medium, or may be a configuration including such a computer-readable medium. For example, the storage device may also include devices within a storage area network (SAN) or other elements, and may be a floppy disk device, a hard disk device, an optical disk device, a tape device, flash memory, or a similar semiconductor memory device or array.

The term 'unit' used in the above-described embodiments means software or a hardware component such as a field-programmable gate array (FPGA) or application-specific integrated circuit (ASIC), and a 'unit' performs a specific role. However, a 'unit' is not limited to software or hardware. A 'unit' may be configured to be present in an addressable storage medium, and also may be configured to run one or more processors. Accordingly, as an example, a 'unit' includes components, such as software components, object-oriented software components, class components and task components, processes, functions, attributes, procedures, subroutines, segments in program code, drivers, firmware, microcode, circuits, data, a database, data structures, tables, arrays, and variables.

Each of the functions provided in components and 'unit(s)' may be coupled to a smaller number of components and 'unit(s)' or divided into a larger number of components and 'unit(s).'

In addition, components and 'unit(s)' may be implemented to run one or more CPUs in a device or secure multimedia card. The above-described embodiments are intended for illustrative purposes. It will be understood that those having ordinary knowledge in the art to which the present invention pertains can easily make modifications and variations without changing the technical spirit and essential features of the present invention. Therefore, the above-described embodiments are illustrative and are not limitative in all aspects. For example, each component described as being in a single form may be practiced in a distributed form. In the same manner, components described as being in a distributed form may be practiced in an integrated form.

The scope of protection pursued via the present specification should be defined by the attached claims, rather than the detailed description. All modifications and variations which can be derived from the meanings, scopes and equivalents of the claims should be construed as falling within the scope of the present invention.

The invention claimed is:

1. A virtual golf simulation device for simulating movement of a ball on a virtual golf course, the virtual golf simulation device comprising:

a memory configured to store a hardness value indicative of a degree of hardness of a terrain in the virtual golf course; and an image processor configured to simulate a movement trajectory of a ball on the virtual golf course based on shot data on a user's golf shot and the hardness value, wherein the image processor simulates the movement trajectory of the ball by adjusting a clamp range based on the hardness value and calculating an out-speed based on the adjusted clamp range.

2. The virtual golf simulation device of claim 1, wherein the image processor simulates the movement trajectory of the ball based on the hardness value of the terrain upon collision after carry of the ball and the shot data.

3. The virtual golf simulation device of claim 1, wherein the image processor simulates the movement trajectory of the ball based on a selected hardness value and the shot data when the hardness value is selected through an interface for displaying a plurality of hardness values.

4. The virtual golf simulation device of claim 1, wherein the image processor simulates the movement trajectory of the ball by correcting the out-speed in a last bounce of the ball based on the hardness value and calculating a rolling distance based on the corrected out-speed.

5. The virtual golf simulation device of claim 1, wherein the image processor simulates the movement trajectory of the ball by changing an x-direction value and y-direction value of a bounce vector when a z-direction value of the bounce vector is changed based on the hardness value.

6. The virtual golf simulation device of claim 1, wherein the image processor simulates the movement trajectory of the ball by correcting a z-direction value of a vector for a next bounce based on the hardness value.

7. A virtual golf simulation device for simulating movement of a ball on a virtual golf course, the virtual golf simulation device comprising:

a memory configured to store a hardness value indicative of a degree of hardness of a terrain in the virtual golf course; and an image processor configured to simulate a movement trajectory of a ball on the virtual golf course based on shot data on a user's golf shot and the hardness value, wherein the image processor simulates the movement trajectory of the ball by determining a bounce damping rate based on the hardness value, calculating a speed damping value based on the bounce damping rate and applying the speed damping value to an out-speed in a next bounce, calculating a vector for the next bounce based on the out-speed, and correcting a z-direction value of the vector.

8. The virtual golf simulation device of claim 1, wherein the image processor simulates the movement trajectory of the ball by correcting a height and distance in a next bounce based on the hardness value.

9. The virtual golf simulation device of claim 1, wherein the image processor simulates the movement trajectory of the ball based on information about the ball used for the golf shot, the shot data, and the hardness value.

10. The virtual golf simulation device of claim 1, wherein the image processor simulates the movement trajectory of the ball based on at least one of weather, season, temperature, humidity, and time when the user's golf shot is made, the shot data, and the hardness value.

11. A virtual golf simulation method by which a virtual golf simulation device simulates movement of a ball on a virtual golf course, the virtual golf simulation method comprising:

storing a hardness value indicative of a degree of hardness of a terrain in the virtual golf course; and simulating a movement trajectory of a ball on the virtual golf course based on shot data on a user's golf shot and the hardness value, wherein simulating the movement trajectory of the ball comprises:

adjusting a clamp range based on the hardness value; and simulating the movement trajectory of the ball by calculating an out-speed based on the adjusted clamp range.

12. The virtual golf simulation method of claim 11, wherein simulating the movement trajectory of the ball comprises simulating the movement trajectory of the ball based on the hardness value of the terrain upon collision after carry of the ball and the shot data.

13. The virtual golf simulation method of claim 11, wherein simulating the movement trajectory of the ball comprises simulating the movement trajectory of the ball by correcting a z-direction value of a vector for a next bounce based on the hardness value.

14. A virtual golf simulation method by which a virtual golf simulation device simulates movement of a ball on a virtual golf course, the virtual golf simulation method comprising:

storing a hardness value indicative of a degree of hardness of a terrain in the virtual golf course; and simulating a movement trajectory of a ball on the virtual golf course based on shot data on a user's golf shot and the hardness value, wherein simulating the movement trajectory of the ball comprises:

determining a bounce damping rate based on the hardness value;

calculating a speed damping value based on the bounce damping rate and applying the speed damping value to an out-speed in a next bounce;

calculating a vector for the next bounce based on the out-speed; and simulating the movement trajectory of the ball by correcting a z-direction value of the vector.

15. The virtual golf simulation method of claim 11, wherein simulating the movement trajectory of the ball comprises simulating the movement trajectory of the ball by correcting a height and distance in a next bounce based on the hardness value.

* * * * *